United States Patent [19]

Toppel

[11] 3,953,992

[45] May 4, 1976

[54] BICYCLE LOCKING DEVICE

[76] Inventor: Morris Toppel, 5460 N. Spaulding Ave., Chicago, Ill. 60659

[22] Filed: June 20, 1974

[21] Appl. No.: 481,148

[52] U.S. Cl. ..... 70/227; 70/14

[51] Int. Cl.[2] ..... E05B 73/00

[58] Field of Search ..... 70/260, 259, 226, 16, 70/238, 203, 212, 227, 236, 18, 19, 14, 15; 24/230.5 AD, 230.5 BH, 230.5 T, 73 HH, 73 HR

[56] References Cited

UNITED STATES PATENTS

| | | | |
|---|---|---|---|
| 337,183 | 3/1886 | Merrill | 70/226 |
| 1,504,220 | 8/1924 | Degen | 70/227 |
| 1,875,734 | 9/1932 | Hurd | 70/19 X |
| 1,971,797 | 8/1934 | Shinn | 70/32 |
| 2,508,302 | 5/1950 | Stue | 70/19 |

*Primary Examiner*—Robert L. Wolfe
*Attorney, Agent, or Firm*—Alter and Weiss

[57] ABSTRACT

A bicycle locking device comprising a pair of plates with oppositely extending hooks which engage with the fork of a bicycle. The plates are positioned in abutment with each other, with opposite extended portions of the hooks received in aligning apertures in each respective second plate. The engaged plates include another set of aligning apertures which receive a lock therethrough.

3 Claims, 3 Drawing Figures

BICYCLE LOCKING DEVICE

This invention relates to locking devices, and more particularly, to a locking device which engages with a bicycle fork.

Bicycles are once again being widely sold throughout the United States. This is due to their moderate cost, their exercise value, and their not requiring expensive fuel for power. It is widely accepted to ride bicycles to work, as well as for fun. However, bicycles are stolen because when they are locked, the lock may be easily removed and the bicycle can then be operated.

Locking devices for use with bicycle wheels or forks are old and well known. However, these devices generally require telescoping parts with complicated and costly lock assemblies integrated therein. Also, the devices generally require special methods for unlocking the assembly or parts permanently attached to different bicycle parts.

These devices are not widely used today because of the many problems which could arise with their use. For example, the locking assembly may be slid up or down the fork portion of the bicycle and easily removed. Thus, the bicycles can be easily stolen.

In the event that the parts are permanently attached to a portion of the bicycle, a person racing would be forced, due to weight factors, to remove the device before the race, and then reattach the device after the race. Such excess weight would surely not be desirable for a bicycle rider. If the device were left on, the excess weight would be undesirable and might even cause one to lose the race.

If one used presently available telescoping devices such as illustrated in U.S. Pat. No. 3,550,409, the proper adjustment of the device is time consuming. For further security the device is often made of steel which is heavy and not convenient to carry from place to place.

Accordingly, an object of this invention is to provide a simple and effective bicycle locking device. More particularly, an object of this invention is to provide a device that need not be permanently attached to the bicycle and only has two parts.

A further object is to provide a bicycle locking device that does not require telescoping parts.

Yet another object is to provide a lightweight bicycle locking device which may be pocket carried and does not add excess weight for a bicycle rider.

Yet another object is to provide a bicycle locking device that cannot be easily removed from a bicycle fork without breaking the bicycle. More particularly, an object is to provide a locking device that cannot be moved up or down the bicycle fork once it is clamped and locked in place.

In keeping with an aspect of the invention, these and other objects are provided by a bicycle locking device comprising a pair of plates with oppositely extending hooks to engage a bicycle fork. These plates are positioned in abutment with each other, with an extended portion of the hooks protruding in an opposite direction of the hooks, received in one set of aligning apertures in the other plates. The engaged plates include another set of aligning apertures which receive a lock therethrough.

The nature of the preferred embodiment may be understood best from a study of the attached drawings in which.

Figure 1:
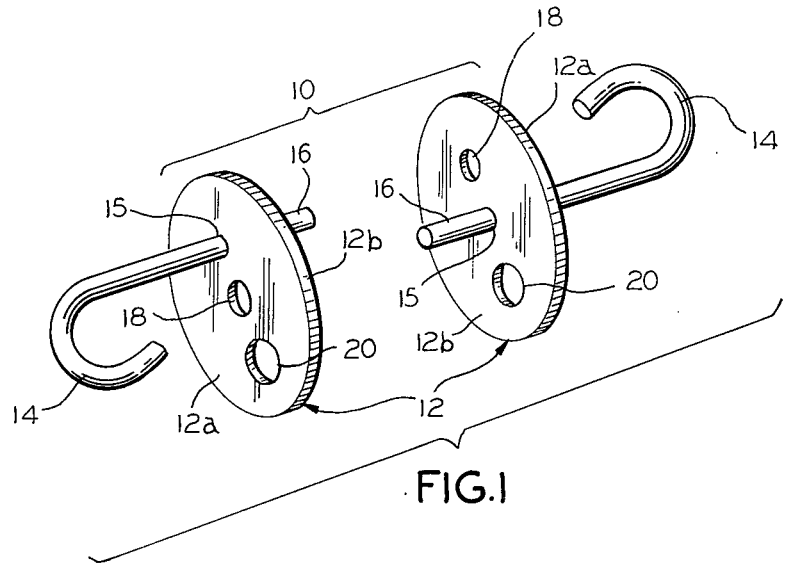
FIG. 1 is an elevational view of the device when not in use.
Figure 2:
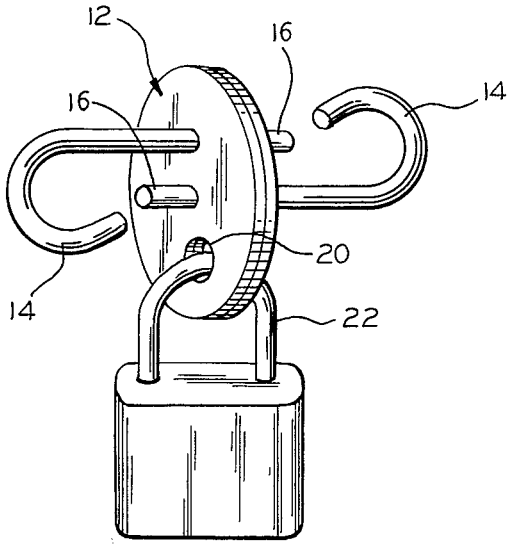
FIG. 2 is the device in a locked position, as in use.

Referring now to the drawings, the bicycle locking device of the present invention is generally designated by the reference numeral 10. The device includes a pair of connecting means 12 each, with a protuberance comprising a capture means 14 extending from one side 12a of each of the connecting means 12, and an opposite extending portion 16 protruding from the opposite side 12b of each of the connecting means 12. The capture means 14 with the extended portion 16 are generally candy cane shaped, with a segment 15 integrally attached to the connecting means 12.

The connecting means 12 are provided for interconnecting the protuberances in a predetermined locking position. In greater detail the connecting means 12 are circular plates with each plate 12 having two sets of aligning apertures 18, 20 therein. Each first aperture 18 receives the extended portion 16 of the capture means 14, and the second aperture 20 receives a lock 22 therethrough. The protuberance is integrally attached to each plate 12 at a point between the hook end 14 and the opposite extended portion 16.

Before the aligning aperture pairs 18, 20 can receive either the opposite extended portion 16 or the lock 22, the plates 12 must be properly placed in abutment with each other with the second sides **12*b* in a cheek-to-cheek relationship. After the plates 12 are properly placed, the apertures 18, 20 are in a proper alignment, whereby the first set of aligning apertures 18 will receive the extended portion 16, and the second set of aligning apertures will receive the lock 22.**

The locking device 10 is made of steel, or any other strong, durable and lightweight metal material that cannot be sawed or severed easily. Because the device engages with a support means such as a bicycle fork, the capture means need not be long, and therefore, even when made of steel, the device remains lightweight.

Figure 3:
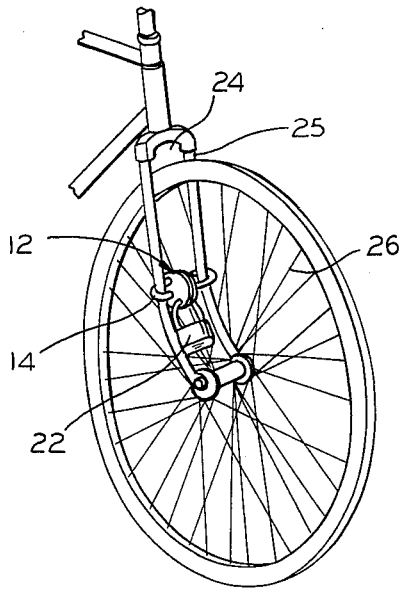
FIG. 3 is the inventive device engaged in the bicycle fork.

In use, the locking device 10 is placed upon the bicycle fork sides 25 as seen in FIG. 3. The capture means 14 hook portions are proportioned to encircle and capture the individual sides 25 of the bicycle fork 24. More particularly, the capture means 14 are hook members with the hooks 14 each attaching onto one of the bicycle fork sides 25. The extended portions 16 are received in the first set of aligning apertures 18 after the plates 12 have been placed properly in abutment with each other. A lock 22 is then inserted in the second set of aligning apertures, thereby locking the bicycle in place. The plates 12 are generally circular shaped, thereby allowing one to easily maneuver the device in place, and also to carry the device in one's pockets without injury due to sharp points.

Attaching the locking device 10 between the bicycle fork sides 25 prevents bicycle wheel movement in either a forward or backward direction. The wheel movement is prevented by not allowing the bicycle spokes 26 to be turned past the plates 12 of the locking device 10. The extended portion 16 enables accommodation of different fork widths, and thereby only two parts are needed. In case of theft, the only way a thief could remove the device is by either breaking the bicycle fork or otherwise damaging the bicycle.

The removal of the device by the owner is easy and may be done quickly with minimum effort. One first removes the lock 22 from the second set of aligning apertures 20, and then pulls the extended portion 16 out of the first set of aligning apertures 18. The device may then be put in one's pocket and carried without fear of cuts. Preferably, the lock 22 is a key type lock, which is more difficult to remove than a combination lock.

Those who are skilled in the art will readily perceive modifications which may be made in the invention. For example, it would be possible to use the invention to lock a motorcycle, tricycle, or the like. Therefore, the appended claims are to be construed to cover all equivalent structures falling within the true scope and spirit of the invention.

I claim:

1. A locking device shaped and proportioned to removably engage with a bicycle support;

said locking device comprising a pair of plates;

said plates each having a protuberance extending through said plates;

said protuberance having a portion extending on both sides of each of said plates;

a first and second aligning aperture in each of said plates; and said plates being in abutment with each other in a locking position whereby said aligning apertures receive a portion of said protuberance in said first aligning aperture and a lock in said second aligning aperture.

2. The locking device of claim 1 wherein said protuberances comprise hook members and opposite extending portions;

said hook members shaped for removable association with one of said bicycle supports;

said opposite extending portions received in said first aligning aperture when said locking device is in said locking position; and said protuberances integrally associated with said plates at a point between said hook members and said opposite extending portion.

3. A locking device to be removably associated with a pair of support members of a vehicle, said locking device comprising:

a pair of flat, circular plates, each said plate having two sides, capture means extending from the first side of each of said plates, each of said capture means being shaped for association with at least one of said members;

a protuberance extending from the second side of each said plate, each said protuberance integrally associated with each said capture means, said protuberance aligning said plates when said locking device is in a locking position, said plates being adapted to have a lock removably associated therewith when said locking device is in said locking position, said locking device being in said locking position when said capture means are associated with said members, and said plates with said protuberances and said capture means being easily maneuverably on said members, and easily carried about when not in use.

* * * * *